US005329650A

United States Patent [19]

Zaccai et al.

[11] Patent Number: 5,329,650

[45] Date of Patent: Jul. 19, 1994

[54] SHOWER STALL CONTROL COLUMN

[75] Inventors: Gianfranco Zaccai, Boston; Arthur S. Rousmaniere, Andover, both of Mass.

[73] Assignee: Herman Miller, Inc., Zeeland, Mich.

[21] Appl. No.: 848,711

[22] Filed: Mar. 6, 1992

[51] Int. Cl.[5] ..... A47K 3/22

[52] U.S. Cl. ..... 4/605; 4/596; 4/597

[58] Field of Search ..... 4/567, 568, 569, 570, 4/596, 597, 598, 599, 600, 601, 602, 603, 604, 605, 606, 607, 608, 609, 610, 611, 612, 613, 614

[56] References Cited

U.S. PATENT DOCUMENTS

| | | | |
|---|---|---|---|
| D. 270,658 | 9/1983 | Sills et al. . | |
| D. 284,689 | 7/1986 | King et al. . | |
| 1,393,103 | 10/1921 | Evensta et al. . | |
| 1,416,172 | 5/1922 | Connolly . | |
| 2,572,463 | 10/1951 | Fine . | |
| 2,787,027 | 4/1957 | Baker . | |
| 2,926,360 | 3/1960 | Erickson et al. . | |
| 3,333,284 | 8/1967 | Symmons . | |
| 3,616,466 | 11/1971 | Davis . | |
| 3,685,745 | 8/1972 | Peschcke-Koedt | 4/596 X |
| 3,874,374 | 4/1975 | Jacuzzi | 128/66 |
| 4,233,692 | 11/1980 | Sinsley | 4/662 |
| 4,383,341 | 5/1983 | Altman . | |
| 4,409,694 | 10/1983 | Barrett, Sr. et al. | 4/545 |
| 4,563,780 | 1/1986 | Pollack . | |
| 4,685,158 | 8/1987 | Lively | 4/508 |
| 4,688.273 | 8/1987 | Lyng . | |
| 4,733,421 | 3/1988 | Kuersteiner . | |
| 4,756,030 | 7/1988 | Juliver . | |
| 4,964,181 | 10/1990 | Alpert | 4/597 |
| 5,070,549 | 12/1991 | Campe | 4/596 |
| 5,121,511 | 6/1992 | Sakamoto et al. | 4/601 |

FOREIGN PATENT DOCUMENTS

| | | | |
|---|---|---|---|
| 60978 | 9/1982 | European Pat. Off. | 4/567 |
| 3738424 | 5/1989 | Fed. Rep. of Germany | 4/612 |
| 1350509 | 12/1963 | France | 4/570 |

OTHER PUBLICATIONS

"The Water Column by Mixet" product brochure (date unknown).

"Fiberglass ShowerPack" product brochure (date unknown).

"The Electronic Kitchen and Bath . . .", Electronic House magazine article (Oct. 1990).

"Granburg Conquers Kitchen & Bath Barriers," Electronic House magazine article (Oct. 1990).

"The Smart Spa: Automating A Spa with Powerline Controls," Electronic House magazine article (Oct. 1990).

*Primary Examiner*—William A. Cuchlinski, Jr.
*Assistant Examiner*—W. Morris Worth
*Attorney, Agent, or Firm*—Willian Brinks Hofer Gilson & Lione

[57] ABSTRACT

A control column includes a housing adapted to be mounted to a side wall of a shower stall adjacent a front edge portion thereof. The housing includes a panel positioned at an angle relative to the side wall and facing a back wall of the shower stall. A shower head assembly extends outward from a top portion of the housing, and water is supplied from a water supply to a bathtub spout or the shower head at a desired temperature and flow rate.

38 Claims, 6 Drawing Sheets

SHOWER STALL CONTROL COLUMN

BACKGROUND OF THE INVENTION

The present invention relates generally to shower stall fixtures, and more particularly, to a control column for use in a shower stall. In conventional shower systems, the plumbing components are mounted behind a wall, which makes maintenance difficult. A user typically faces the wall of a shower while showering since the shower head usually extends from the middle of the wall. In addition, residential shower typically receive light from a remote source in a bathroom. Other features, such as soap dishes, shelves, or the like are often dispersed throughout various locations in the shower stall. Many users also avoid using electronic devices such as telephones, radios, or the like in the shower stall or tube area of a bathroom.

Previous shower systems have included plumbing fixtures in the form of a vertical column. In U.S. Pat. No. 3,333,284, Symmons discloses a modular shower bath unit adapted to be mounted to the surface of a finished wall. The modular unit includes U-shaped cover member which conceals a mixing valve, water supply pipes, and a mixed water delivery pipe leading to a shower head assembly. The shower head assembly and cover member form a discrete sub-assembly which can remain intact when the cover is removed for inspection or repair of the mixing valve. A bottom end of the cover member in Symmons may be open or closed off by providing a soap dish which functions as an end plate.

U.S. Pat. No. 3,616,466 to Davis disclosed a vertically adjustable shower head including an elongated casing mounted to a shower wall. A side wall of the casing has a slot therein for slidable adjustment of the shower head, and an elongated flexible hose is provided for conducting water from a supply conduit to the shower head.

U.S. Pat. No. 4,733,421 to Kuersteiner discloses a massaging and washing apparatus comprising a vertically upright and rotatable brush roller mounted in a watertight housing. A plurality of downwardly directed water nozzles produce a curtain of water in front of the brush roller for washing, and air-jet nozzles are arranged in vertical edges of the housing for drying.

U.S. Pat. No. Des. 284,689 to King et al. discloses a corner molding for tub surrounds which includes a pair of vertically spaced, apart, recessed soap dishes.

In addition, bathtubs having control knobs positioned on a side wall thereof for controlling the temperature and flow of water are disclosed in U.S. Pat. Nos. 1,416,172 (Connolly), 2,572,463 (Fine), 2,926,360 (Erickson et al.), 3,874,374 (Jacuzzi), 4,383,341 (Altman), and Des. 270,658 (Sills et al.).

SUMMARY OF THE INVENTION

Briefly stated, the invention is directed to a control column including a housing adapted to be mounted to a side wall of the shower stall adjacent a front edge portion thereof. The housing includes a panel positioned at an angle relative to the side wall and facing a back wall of the shower stall. A shower head assembly extends outward from a top portion of the panel. Means for supplying water from a water supply to the shower head assembly, a tub spout, and a hand-spout are positioned inside the housing. Valve means for controlling the flow and temperature of water and control means for receiving and sending a desired flow and temperature signal to the valve means are also positioned inside the housing. Means accessible from outside the housing are also provided for sending said signal to the control means.

In a preferred embodiment, a telephone and sound system are positioned inside the housing. The telephone includes a speaker, receiver, and means accessible from outside the housing for dialing a desired telephone number. The sound system similarly includes a speaker, receiver, and means accessible from outside the housing for selecting a desired radio station. A recess is preferably formed in the panel for placing various articles thereon, and blower means are provided to withdraw air through a vent formed in a top portion of the panel. An upper light is positioned at the top of the housing and a lower light is positioned at the bottom of the housing. In addition, the shower head assembly includes an arm pivotally attached to the housing which extends outward from a top portion of the housing toward the back wall and away from the side wall of the shower stall.

The present invention provides significant advantages over other plumbing fixtures. A plurality of plumbing components, light, a vent, a radio and a telephone are all conveniently located in a single housing. All of these features are actuated by a control pad and/or knobs extending from the housing. Furthermore, water can be directed to shower head assembly, a tub spout, or a hand-spout from the housing control pad or from a pad on the side wall of a bathtub. The front panel of the housing and shower head assembly is also angled relative to the shower stall wall to provide convenient access for a person standing in the stall and allow the person to face the open bathroom rather than a wall. This geometry also directs the water from the shower head toward a rear wall of the shower stall rather than outwardly toward the bathroom. In addition, a recess is formed in the panel for placing various articles such as soap or the like thereon, and the components in the control column are easily maintained since they are readily accessible from outside the control column housing.

The present invention, together with further objects and advantages, will be best understood by reference to the following detailed description taken in conjunction with the accompanying drawings.

DETAILED DESCRIPTION OF THE PREFERRED EMBODIMENTS

Figure 1:
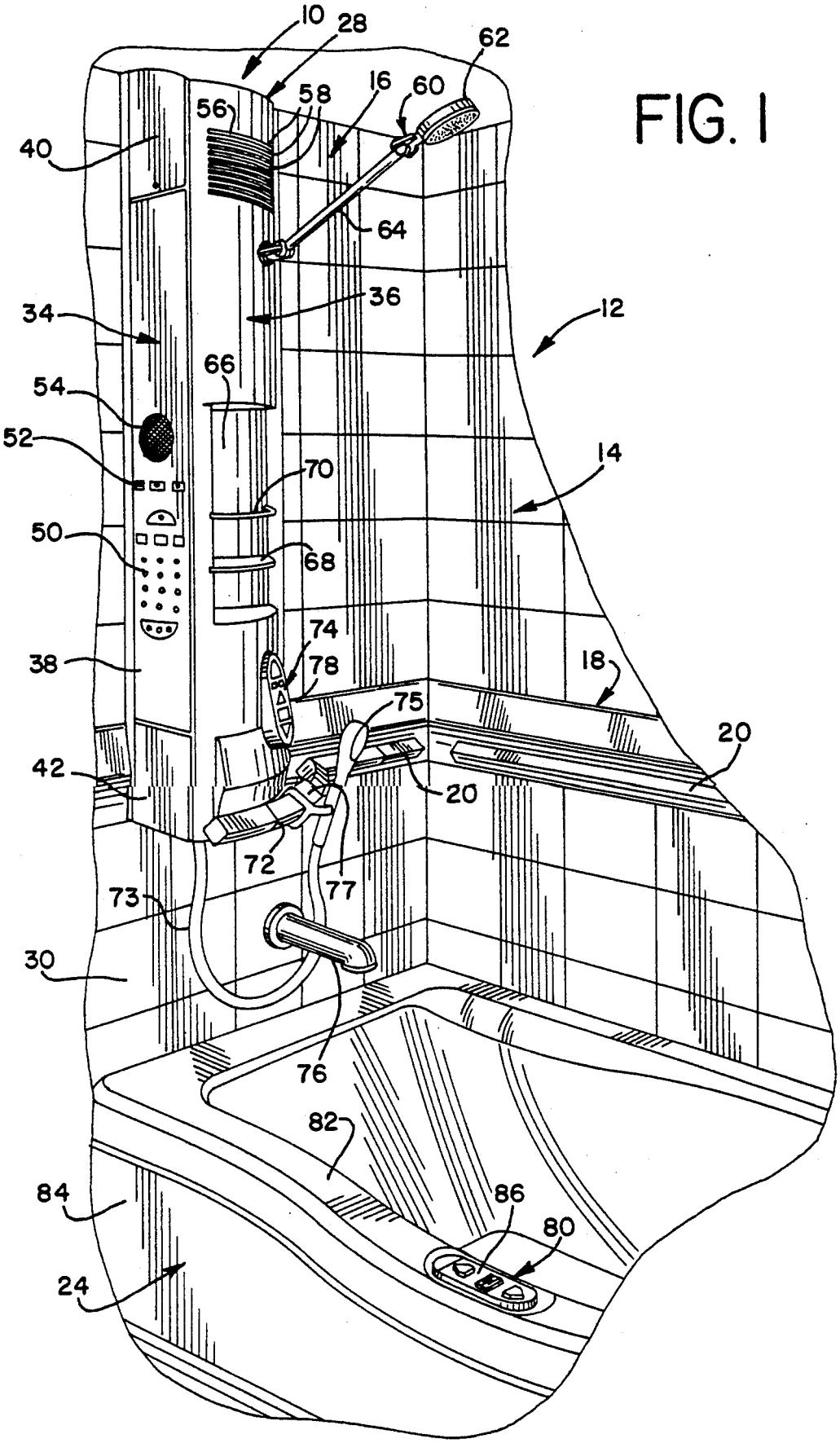
FIG. 1 is a perspective view of a preferred embodiment of the invention showing a control column mounted to the wall of a shower stall having a bathtub.
Figure 2:
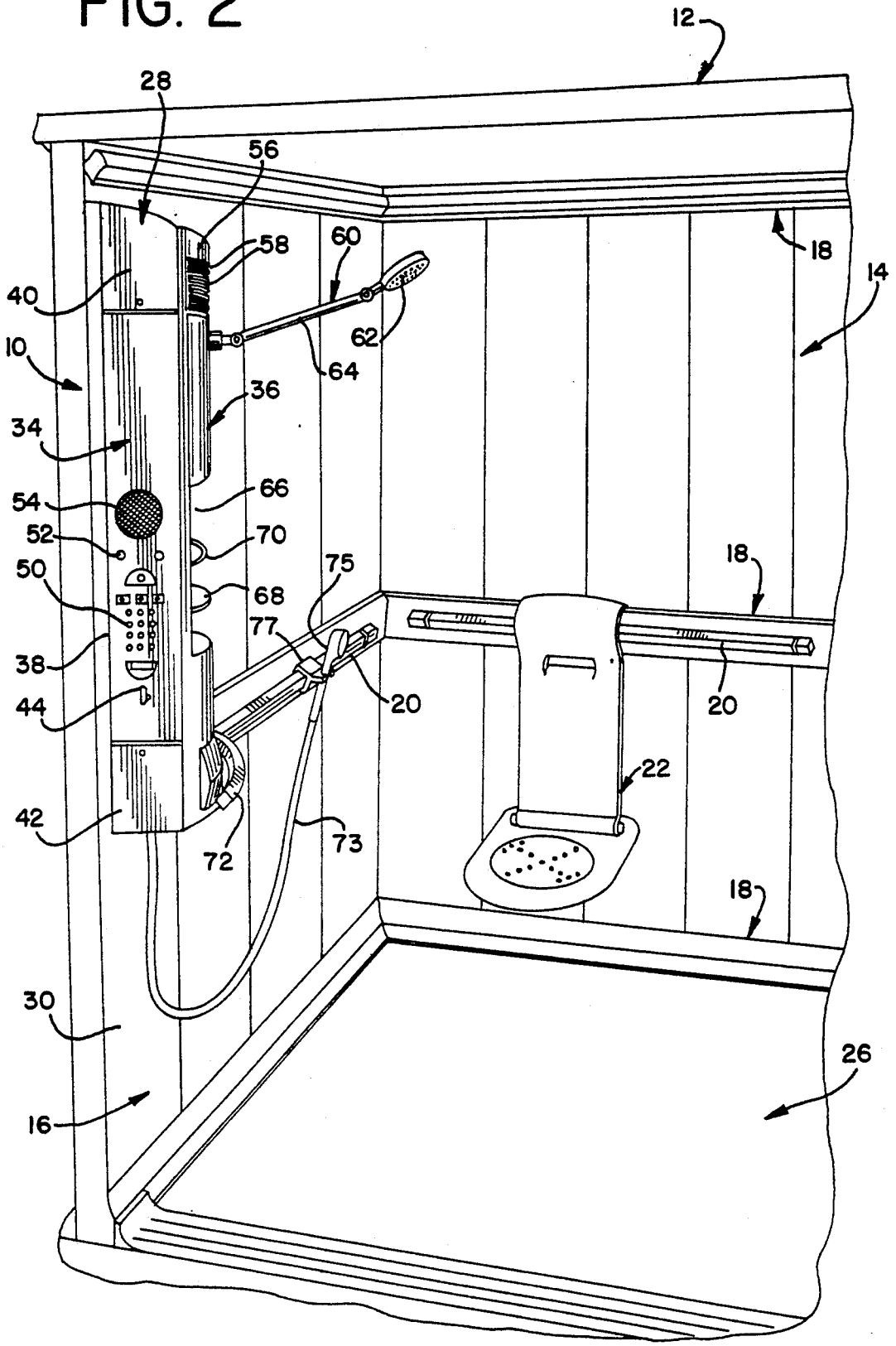
FIG. 2 is a perspective view of the invention showing the control column mounted to the wall of a shower stall without a bathtub.

Referring to the drawings, FIGS. 1 and 2 show a preferred embodiment of a control column indicated generally at 10. The control column 10 is installed in a shower stall 12 defined by a back wall 14 and side walls 16 comprising plastic or stone tiles, panels or the like. The shower stall 12 preferably includes a rail system 18 of the type described in U.S. patent application Attorney U.S. patent application Ser. No. 07/848,426, the disclosure of which is specifically incorporated herein by reference. The rail system 18 includes a horizontal bar 20 which supports various articles thereon such as a foldable seat assembly 22 (FIG. 2). Preferably, the shower stall 12 has a bathtub 24 as shown in FIG. 1 or a shower pan 26 as shown in FIG. 2 and described in U.S. Pat. No. 5,243,716, the disclosure of which is specifically incorporated herein by reference. The control column 10 can also be installed in a shower stall having conventional walls and conventional bathtubs or shower pans.

Referring now to FIGS. 1–6, the control column 10 includes an elongated vertical housing 28 and is preferably mounted to a front edge portion 30 of the side wall 16 defining part of the shower stall 12. The housing 28 includes a support wall 32, a side panel 34, and a curved front panel 36. The support wall 32 is positioned parallel to the side wall 16 of the shower stall 12 and the side panel 34 is perpendicular to the support wall 32. The support wall 32 preferably includes tab members 37 (FIG. 4) which are secured to a substrate 39 or a pair of studs 41 behind the substrate 39. The front panel 36 is positioned at an angle relative to the support wall 32 and side panel 34 and faces the back wall 14 of the shower stall 12. Preferably, the front panel 36 curves such that an end thereof is flush with the side wall 16 to provide an attractive, smooth transition between the column 10 and the shower stall wall 16. The control column 10 can be mounted to any desired location within the shower stall 12, and a desired number of panels of the housing can have various shapes to accommodate the positioning of the column. For example, the housing can comprise only one semi-circular panel or it can include a number of flat panels.

The side panel 34 preferably has middle section 38 and removable upper and lower sections 40 and 42 which provide access to the interior of the control column 10. The side panel 34 includes a touch-pad 50, control knobs 52, and a speaker 54. The touch-pad 50 and control knobs 52 are adapted to actuate a radio 55 and a telephone, intercom, or the like (not shown) positioned inside the housing 28. The telephone can be adapted to include a pre-recorded message for requesting emergency assistance and/or means for storing a desired number of telephone numbers. The radio 55 and telephone can also be activated by a remote control device.

The curved front panel 36 faces the back wall 14 of the shower stall 12 at an angle for convenient access thereto by a person standing in the shower stall. A vent 56 comprising a plurality of spaced apart, horizontal openings 58 is formed in an upper portion of the front panel 36, and a shower head assembly 60 extends outwardly therefrom in a substantially normal direction. The shower head assembly 60 is preferably manufactured by Reon, Inc. and includes a shower head 62 and an arm 64 pivotally attached to the front panel 36 to allow vertical adjustment of the shower head 62. The position of the housing 28 adjacent a front edge portion 30 of the side wall 16, the angle of the front panel 36, and the position of the shower head assembly 60 allows water to flow in a direction toward the back wall 14 of the shower stall 12. The shower head 60 can also be adapted to rotate about the axis of the arm 64. As a result, a person sitting on the seat assembly 22 can receive a direct flow of water as well as a person standing in the approximate center of the shower pan 26 or bathtub 24. Such a configuration also allows a person standing in the shower stall to face outwardly toward an open bathroom rather than facing the wall of the shower stall. Directing the flow of water in a rearwardly direction also reduces the need for a shower curtain.

The front panel 36 also has a recess 66 formed therein including a shelf 68 for placing various articles thereon. A support bar 70 is also provided for retaining the articles on the shelf 68. To provide a support for a person to grab onto or to place various articles thereon, a curved bar 72 extends outwardly from a lowermost portion of the front panel 36. The bar 72 is preferably the same general configuration as the bar 20 of the rail system 18 and also conforms to the shape of the front panel 36. In addition, a water hose 73 leads from the water column 10 to a hand-wand 75 which is removably attached to the bar 20 or 72 by an adapter 77 having a channel for receive the bars.

A touch pad 74 extends outwardly from a lower portion of the front panel 36 for actuating the flow and temperature of water from a water supply to the hand-wand 75, the shower head assembly 60, or a tub spout 76. A front face 78 of the touch pad 74 is preferably angled upwardly to provide easy access thereto. When the control column 10 is installed in a shower stall having a bathtub 24 as shown in FIG. 1, a second touch pad 80 is preferably positioned within a recess formed in a top surface 82 of a side wall 84 of the bathtub 24. The touch pad 80 is adapted to actuate the flow and temperature of water from a water supply to the hand-wand 75 or the tub spout 76, and a flexible membrane 86 overlies the touch-pad 80 to prevent water from reaching the touch pad 80.

Any number of shelves 68 and support bars 70 can be positioned within the recess 66, and the recess can be any shape or size as long as enough space remains inside the housing 10 for the components therein. The bar 72 need not be provided, and conventional knobs, mechanical control devices or the like can be used to actuate the flow and temperature of water.

Figure 3:
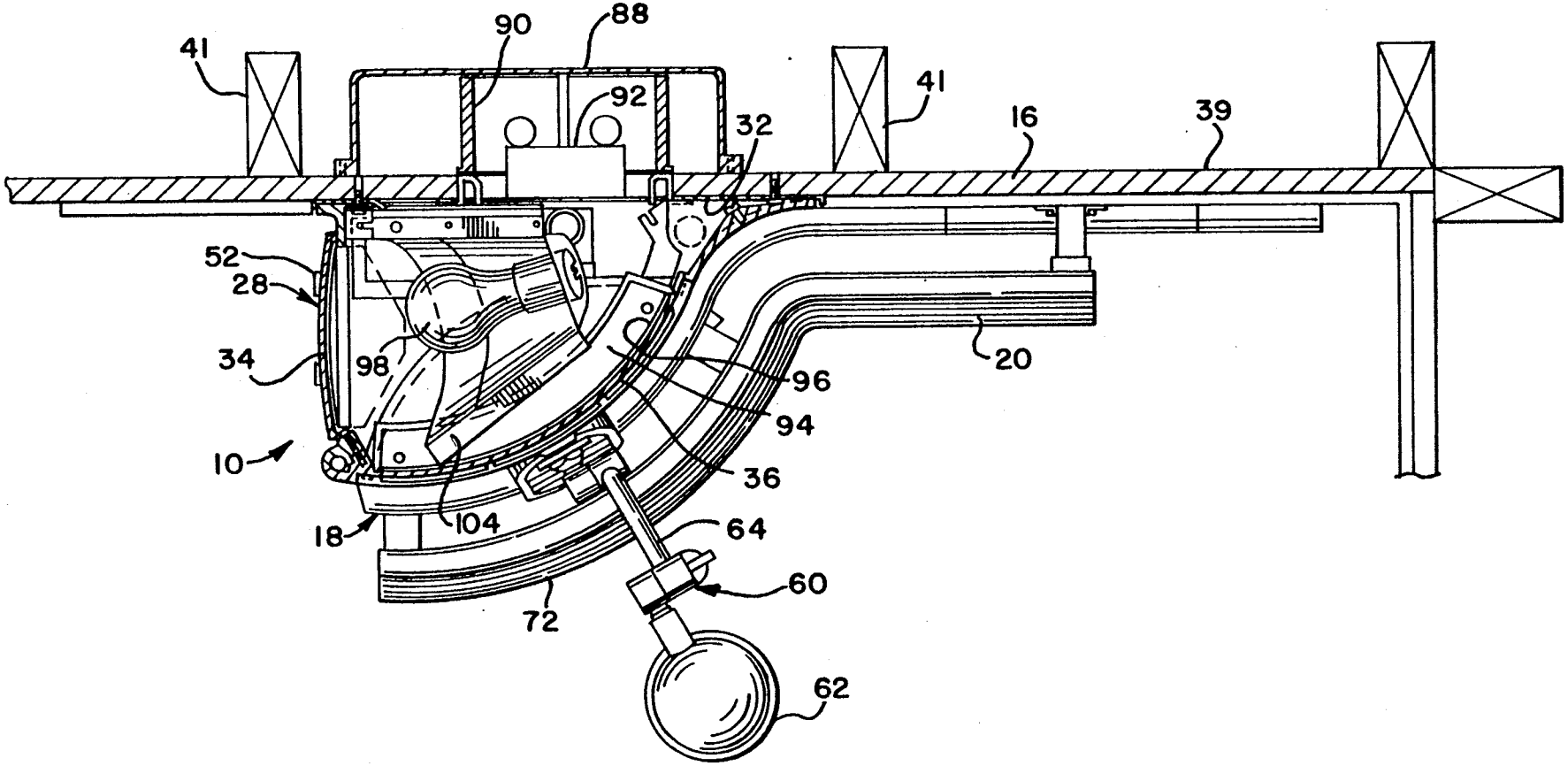
FIG. 3 is a top view of the water column.
Figure 4:
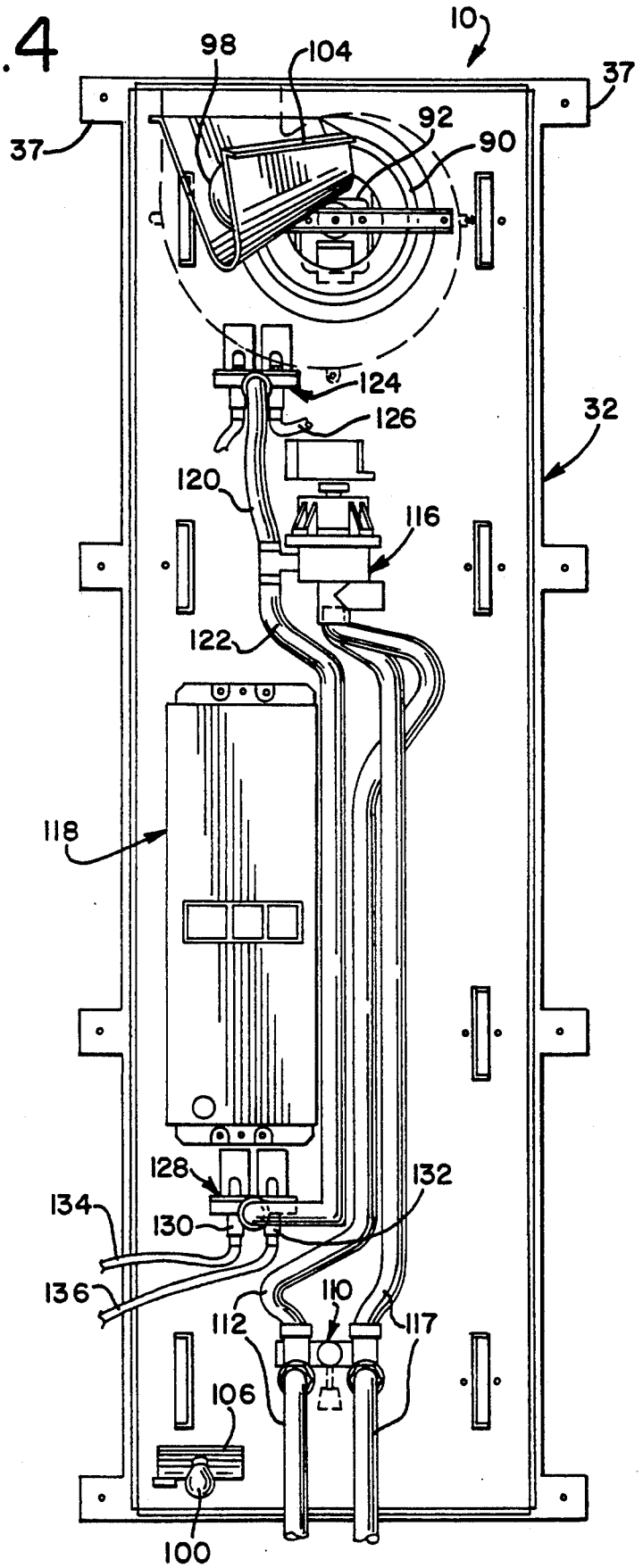
FIG. 4 is a front view of the water column shown with a front panel removed for clarity.
Figure 5:
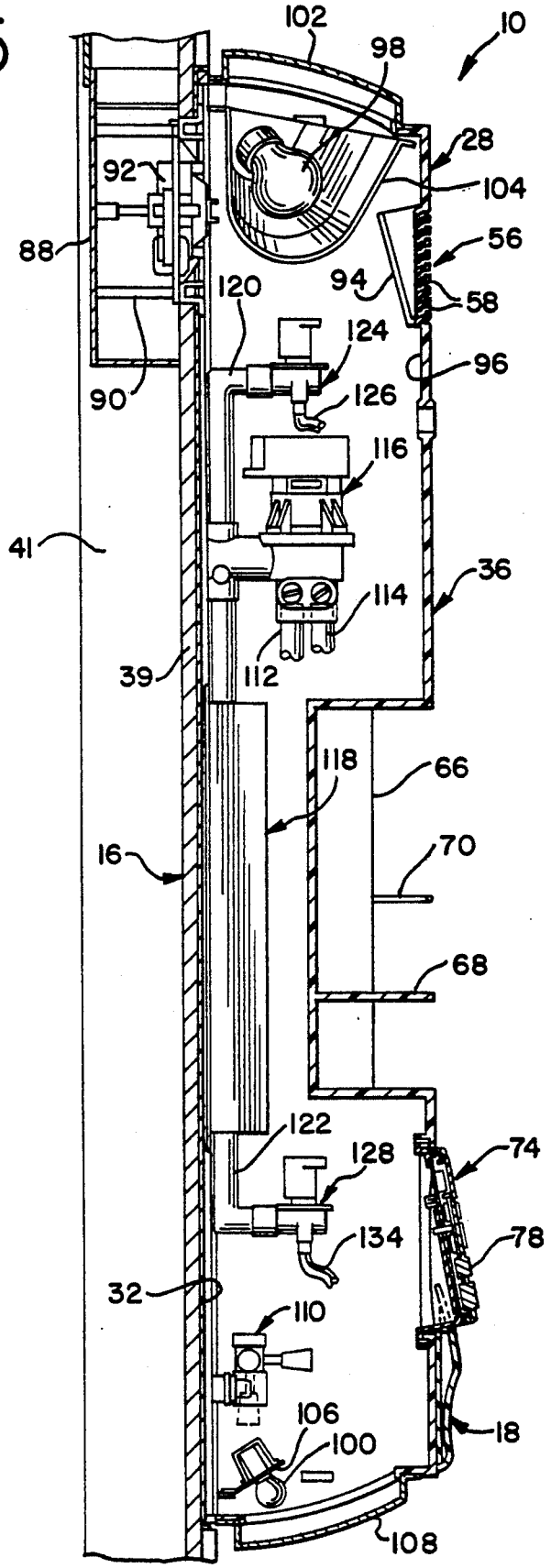
FIG. 5 is a side view of the water column shown with a side panel removed for clarity.
Figure 6:
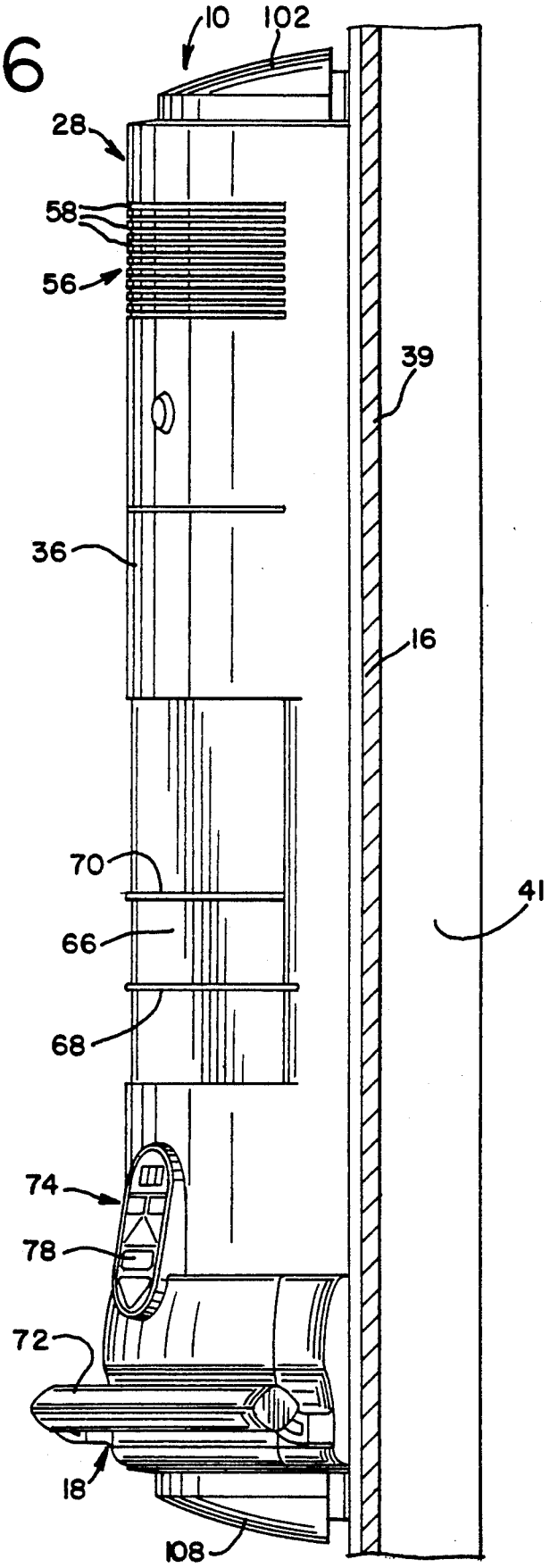
FIG. 6 is a back side view of the water column shown with the panel removed for clarity.

Referring now to FIGS. 3–5, a blower housing 88 extends rearwardly from the column housing 28 behind the substrate 39. A squirrel-cage impeller 90 is mounted within the blower housing 88 and is rotatably driven by a motor 92, preferably a Grainger Model #4M076. To prevent water from reaching the interior components of the column 10, a baffle 94 is mounted to an interior surface 96 of the front panel 36 adjacent the vent 56.

Preferably, an upper light 98 is positioned inside the housing 28 adjacent a top portion thereof, and a lower light 100 is positioned inside the housing 28 adjacent a bottom portion thereof. To reflect light upward through a transparent top lens 102 which is mounted to the top of the housing 28, an upper shroud 104 is positioned below the upper light 98. A lower shroud 106 is also positioned above the lower light 100 to reflect light downward through a transparent bottom lens 108. The lenses 102 and 108 provide the additional function of protecting the lights 98 and 100 from water and water vapor while a person is taking a shower.

As best shown in FIGS. 4–5, a plurality of conventional plumbing components, preferably manufactured and sold by Memry Plumbing Products Co., are positioned within the housing 28. A manual shut-off valve 110 is coupled to a hot water supply line 112 and a cold water supply line 114. The supply lines 112 and 114 lead to a thermostatically controlled mixing valve 116 which mixes the hot and cold water in proportion to a desired temperature signal received from a microprocessor 118. A first mixer delivery line 120 and second mixer delivery line 122 lead from the mixer 116. The first mixer delivery line 120 is coupled to a flow control valve 124 which opens and closes in response to a signal from the microprocessor 118. If the valve 124 is in an open position, water flows through a shower line 126 to the shower head assembly 60. The second mixer delivery line 122 is coupled to a three-way flow control valve 128, preferably an Eaton N-43 type, including a hand-wand valve 130 and a tub spout valve 132 which also open and close in response to a signal from the microprocessor 118. If the hand-wand valve 130 is in an open position, water flows through a hand-wand line 134 and the hose 48, and out the hand wand 75. Likewise, if the tub spout valve 132 is in an open position, water flows through a tub line 136 and out the tub spout 76.

In operation, a user presses the appropriate portion of the touch pad 74 or 80 to send a desired temperature, flow rate and source signal to the microprocessor 118. As a result, the microprocessor 118 sends a signal to the mixing and flow control valves 116, 124, and 128 which causes water to exit the shower head 62, hand-wand 75, or tub spout 76 at a desired flow rate and temperature. In addition, a user can press a desired portion of the touch-pad 50 and turn control knobs 52 to actuate the sound system or dial a telephone number.

To facilitate installation of the control column 10, the water lines 112, 114, 117, 120, 122, 126, 134, and 136 are made of a suitable flexible material such as reinforced rubber or the like. Prior to installation of the control column 10, a plumber installs the shut-off valve 110. The support wall 32 is then mounted to the wall 16. The mixing and flow control valves 116, 124, and 128, along with their associated fittings, are preassembled to the support wall 32. The rest of the housing 28 is then mounted to the support wall 32, and the water lines 112, 114, 117, 120, 122, 126, 134, and 136 are connected to the appropriate plumbing components. This configuration greatly facilitates maintenance since the plumbing components are readily accessible by merely removing the upper and lower portions 40 and 42 of the side panel 34.

Thus, an attractive, convenient control column is provided which houses a plurality of plumbing components, lights, a vent, a radio and a telephone with emergency calling capability. The components in the control column are easily maintainable, and a recess is provided for placing various articles thereon such as a soap dish or the like.

Although the present invention has been described with reference to preferred embodiments, those skilled in the art will recognize that many changes may be made in form and detail without departing from the spirit and scope of the invention. As such, it is intended that the foregoing detailed description be regarded as illustrative rather than limiting and that is the appended claims which are intended to defined the scope of the invention.

We claim:

1. A system for use in a shower stall, the system comprising:

a housing adapted to be mounted to a wall;

a shower head assembly extending outward from a top portion of the housing, said shower head assembly including a shower head;

a hand-held nozzle attached by a flexible line to the housing;

a plurality of supply lines positioned inside the housing for supplying water from a water supply to a bathtub spout, the shower head, and the hand-held nozzle;

a valve system connected to said supply lines and positioned inside the housing for controlling the flow and temperature of water to one of said bathtub spout, shower head, and hand-held nozzle;

a signaling device accessible from outside the housing and adapted to send a first desired flow signal and temperature signal to a control device; and a control device positioned inside the housing for receiving said first flow signal and temperature signal and sending a second corresponding flow signal and temperature signal to the valve system, said valve system adapted to respond to said second signals.

2. The system of claim 1, further comprising a light positioned at the top of the housing.

3. The system of claim 2, further comprising a light positioned at the bottom of the housing.

4. The system of claim 1, further comprising a light positioned at the bottom of the housing.

5. The system of claim 1, further comprising a blower adapted to withdraw air through a vent in the housing, said vent comprising a plurality of spaced apart apertures.

6. The system of claim 1, further comprising a telephone positioned inside the housing, said telephone including a speaker, receiver, and means accessible from outside the housing for dialing a desired telephone number.

7. The system apparatus of claim 1, further comprising a sound system positioned inside the housing, said sound system including a speaker, receiver, and means accessible from outside the housing for selecting a desired radio station.

8. The system of claim 1, wherein the housing is mounted to a side wall of the shower stall adjacent a front edge portion thereof and includes a panel positioned at an angle relative to the side wall and facing a back wall of the shower stall.

9. The system of claim 1, wherein the control device comprises a microprocessor, wherein the supply lines comprise a plurality of water supply and delivery lines in fluid flow communication with the valve system, and the valve system compises a manual shut-off valve, a thermostatically controlled mixing valve, and first and second flow control valves, said microprocessor, water supply and delivery lines, shut-off valve, mixing valve, and flow control valves adapted to be readily removed from the housing.

10. The system of claim 9, further comprising a removable panel covering an access opening formed in the housing to provide access for mainteance and replacement of said microprocessor, water supply and delivery lines, shut-off valve, mixing valve, and flow control valves.

11. The system of claim 9, wherein the signaling device comprises a touch-pad mounted to the housing and configured to send said first temperature and flow signal to the microprocessor in response to a user touching a portion of the pad.

12. The system of claim 9, wherein the signaling device comprises a touch-pad mounted to a top surface of a bathtub side wall, said touch-pad configured to send said first temperature and flow signal to the microprocessor in response to a user touching a portion of the pad.

13. A system for use in a shower stall, the system comprising:

a housing adapted to be mounted to a side wall of the shower stall adjacent a front edge portion thereof, said housing including a panel positioned at an angle relative to the side wall and facing a back wall of the shower stall;

a shower head assembly extending outward from a top portion of the housing, said shower head assembly including a shower head;

at least one supply line positioned inside the housing for supplying water from a water supply to the shower head assembly;

a valve system connected to said supply line and positioned inside the housing for controlling the flow and temperature of water to said shower head;

a signaling device accessible from outside the housing and adapted to send a first desired flow signal and temperature signal to a control device; and a control device positioned inside the housing for receiving said first flow signal and temperature signal and sending a second corresponding flow signal and temperature signal to the valve system, said valve system adapted to respond to said second signals.

14. The system of claim 13, further comprising a light mounted to the housing.

15. The system of claim 14, wherein the light is positioned at the top of the housing.

16. The system of claim 15, further comprising a light positioned at the bottom of the housing.

17. The system of claim 13, further comprising a blower adapted to withdraw air through a vent in the housing, said vent comprising a plurality of spaced apart apertures formed in the housing.

18. The system of claim 13, further comprising a telephone positioned inside the housing, said telephone including a speaker, receiver, means remote from the housing for dialing a desired telephone number, and means for storing desired numbers and sending prerecorded emergency messages.

19. The system of claim 13, further comprising a sound system positioned inside the housing, said sound system including a speaker, receiver, and means accessible from outside the housing for selecting a desired radio station.

20. The system of claim 13, wherein the housing has a recess formed in a panel thereof for the placing of various articles thereon.

21. The system of claim 13, wherein the shower head assembly extends outward from said panel toward a back wall and away from a side wall of the shower stall.

22. The system of claim 13, wherein the shower head assembly includes an arm pivotally attached to the housing to allow vertical adjustment of the shower head.

23. The system of claim 13, wherein the signaling device comprises a touch-pad mounted to the housing, said touch-pad being configured to send said first temperature and flow signal to the control device in response to a user touching a portion of the pad.

24. The system of claim 13, further comprising a touch-pad mounted to a top surface of a bathtub side wall for sending said first flow and temperature signal to the control device, the control device being adapted to send said second signal to the valve system, and the valve system and supply lines being adapted to direct water to a tub spout at a desired temperature in response to said second signal.

25. The system of claim 24, wherein the touch-pad is positioned within a recess formed in the top surface of the bathtub side wall, and a flexible membrane overlies the touch-pad to prevent water from reaching said pad.

26. A system for providing water, air, light and sound to a shower stall defined by a back wall and side walls, the apparatus comprising:

a vertical housing mounted to one of said side walls adjacent a front edge portion thereof, said housing having a panel positioned at an angle relative to the side wall and facing the back wall, said panel having a vent in a top portion thereof comprising a plurality of spaced apart apertures;

an upper light positioned inside the housing adjacent an upper portion thereof;

a lower light positioned inside the housing adjacent a lower portion thereof;

a blower adapted to withdraw air through the vent;

a telephone positioned inside the housing, said telephone including a speaker, receiver, and means for dialing a desired telephone number, the means for dialing being accessible from outside the housing;

a sound system positioned inside the housing, said sound system including a speaker, receiver, and means for selecting a desired station, the means for selecting a station being accessible from outside the housing;

a shower head assembly extending outward in a substantially normal direction from a top portion of said housing panel toward the back wall and away from the side wall of the shower stall, the shower head assembly including a shower head and an arm pivotally attached to the housing to allow vertical adjustment of the shower head;

a plurality of supply lines positioned inside the housing for supplying water from a water supply to the shower head and a bathtub spout;

a valve system connected to said supply lines and positioned inside the housing for controlling the flow and temperature of water to one of said bathtub spout and shower head;

a signaling device accessible from outside the housing and adapted to send first desired signals to a control device for actuating the lights, the blower, and the valve system;

a control device positioned inside the housing for receiving said first signals and sending corresponding second signals to actuate the lights, the blower, and the valve system.

27. The system of claim 26, further comprising an upper shroud positioned below the upper light and a lower shroud positioned above the lower light, said upper shroud being adapted to reflect light upward and away from the side wall of the shower stall, and said lower shroud being adapted to reflect light downward and away from the side wall of the shower stall.

28. The system of claim 26, wherein said housing panel has a recess formed therein for the placing of various articles thereon.

29. The system of claim 26, wherein the blower is mounted within the shower stall wall.

30. The system of claim 26, wherein said supply lines comprises hot and cold water supply lines connected to a manual shut-off valve, hot and cold flexible lines connected to the shut-off valve and a thermostatically controlled mixing valve, a first flexible mixer delivery line connected to the mixing valve and a first flow control valve, a second flexible mixer delivery line connected to the mixing valve and a second flow control valve, a flexible shower line connected to the first flow control valve and the shower head assembly, and a flexible tub line connected to the second flow control valve and a tub spout, said water supply and delivery lines, shut-off valve, mixing valve, and flow control valves adapted to be readily removed from the housing.

31. The system of claim 30, further comprising a flexible hand-spout line connected to the second flow control valve and a hand-spout.

32. The system of claim 30, wherein the control device comprises a microprocessor, and said microprocessor, water supply and delivery lines, shut-off valve, mixing valve, and flow control valves are adapted to be readily removed from the housing.

33. The system of claim 26, wherein the signaling device comprises a touch-pad mounted to the housing, said touch-pad being configured to send said first signals to the control device in response to a user touching a portion of the pad.

34. The system of claim 33, wherein the signaling device further comprises a touch-pad mounted to a top surface of a bathtub side wall, said touch-pad being configured to send said first signals to the control device in response to a user touching a portion of the pad.

35. The system of claim 34, wherein the touch-pad is positioned within a recess formed in the top surface of the bathtub side wall, and a flexible membrane overlies the touch-pad to prevent water from reaching said pad.

36. An apparatus for use in a shower stall, the apparatus comprising:

a housing adapted to be mounted to a wall;

a shower head assembly extending outward from a top portion of the housing, said shower head assembly including a shower head;

a hand-held nozzle attached by a flexible line to the housing;

means positioned inside the housing for supplying water from a water supply to a bathtub spout, the shower head, and the hand-held nozzle;

valve means positioned inside the housing for controlling the flow and temperature of water to one of said bathtub spout, shower head, and hand-held nozzle;

control means positioned inside the housing for receiving a first flow signal and temperature signal and sending a second flow signal and temperature signal to the valve means; and means accessible from outside the housing for sending said first flow signal and temperature signal to the control means.

37. An apparatus for use in a shower stall, the apparatus comprising:

a housing adapted to be mounted to a side wall of the shower stall adjacent a front edge portion thereof, said housing including a panel positioned at an angle relative to the side wall and facing a back wall of the shower stall;

a shower head assembly extending outward from a top portion of the housing, said shower head assembly including a shower head;

means positioned inside the housing for supplying water from a water supply to the shower head assembly;

valve means positioned inside the housing for controlling the flow and temperature of water to said shower head;

control means positioned inside the housing for receiving a first flow signal and temperature signal and sending a second flow signal and temperature signal to the valve means; and means accessible from outside the housing for sending said first flow signal and temperature signal to the control means.

38. An apparatus for use in a shower stall defined by a back wall and side walls, the apparatus comprising:

a vertical housing mounted to one of said side walls adjacent a front edge portion thereof, said housing having a panel positioned at an angle relative to the side wall and facing the back wall, said panel having a vent in a top portion thereof comprising a plurality of spaced apart apertures;

an upper light positioned inside the housing adjacent an upper portion thereof;

a lower light positioned inside the housing adjacent a lower portion thereof;

blower means adapted to withdraw air through the vent;

a telephone positioned inside the housing, said telephone including a speaker, receiver, and means for dialing a desired telephone number, the means for dialing being accessible from outside the housing;

a sound system positioned inside the housing, said sound system including a speaker, receiver, and means for selecting a desired station, the means for selecting a station being accessible from outside the housing;

a shower head assembly extending outward in a substantially normal direction from a top portion of said housing panel toward the back wall and away from the side wall of the shower stall, the shower head assembly including a shower head and an arm pivotally attached to the housing to allow vertical adjustment of the shower head;

means positioned inside the housing for supplying water from a water supply to the shower head and a bathtub spout;

valve means positioned inside the housing for controlling the flow and temperature of water to one of said bathtub spout and shower head;

control means positioned inside the housing for receiving a first flow signal and temperature signal and sending a second flow signal and temperature signal to blower means, and valve means; and means accessible from outside the housing for sending said first flow signal and temperature signal to the control means.

* * * * *